US005589824A

United States Patent [19]

Lynch

[11] Patent Number: 5,589,824

[45] Date of Patent: Dec. 31, 1996

[54] MULTI-SENSOR DETECTION SYSTEM

[76] Inventor: Adam Q. Lynch, 75 N. Lakeside Dr., Madison, Ind. 47250

[21] Appl. No.: 556,201

[22] Filed: Nov. 9, 1995

[51] Int. Cl.[6] ..... G08B 17/10

[52] U.S. Cl. ..... 340/628; 340/577; 340/584; 340/632; 340/693

[58] Field of Search ..... 340/577, 584, 340/628, 629, 630, 693, 632

[56] References Cited

U.S. PATENT DOCUMENTS

| | | | |
|---|---|---|---|
| Re. 30,620 | 5/1981 | Sweany et al. | 340/629 |
| 2,938,493 | 5/1960 | Pratt | 116/106 |
| 2,999,477 | 9/1961 | Pratt et al. | 116/106 |
| 3,153,226 | 10/1964 | Jensen | 340/630 |
| 3,795,983 | 3/1974 | Gallagher et al. | 283/103 |
| 3,803,527 | 4/1974 | Gallagher et al. | 337/409 |
| 3,938,115 | 2/1976 | Jacoby | 340/628 |
| 4,088,986 | 5/1978 | Boucher | 340/628 |
| 4,563,727 | 1/1986 | Curiel | 362/183 |
| 4,694,285 | 9/1987 | Scripps | 340/693 |
| 5,146,209 | 9/1992 | Beghelli | 340/628 |
| 5,331,310 | 7/1994 | Stetter et al. | 340/628 |
| 5,394,934 | 3/1995 | Rein et al. | 165/16 |
| 5,461,365 | 10/1995 | Schlager et al. | 340/573 |

*Primary Examiner*—Jeffery Hofsass
*Assistant Examiner*—Daniel J. Wu
*Attorney, Agent, or Firm*—Chase & Yakimo

[57] ABSTRACT

An alarm for sensing different conditions of an ambient air presents a housing for an alarm circuit, the housing having lobes for first, second and third circuit sensors surrounding a single circuit alarm. The alarm circuit delivers the current to a logic chip which produces a current for sounding the alarm in different patterns according to the sensed air condition. The configuration of the housing depends the alarm below the housing proper so as not to interfere with the alarm sound. The housing allows the installation of three air condition sensors at one selected location.

17 Claims, 7 Drawing Sheets

FIG. 1

MULTI-SENSOR DETECTION SYSTEM

BACKGROUND OF THE INVENTION

This invention relates to a warning device and, more particularly, to a housing for a warning system capable of detecting the presence of various dangerous ambient air conditions and providing a warning signal according to said sensed conditions.

The use of various types of alarms to sense potentially dangerous conditions in the home, such as carbon monoxide, smoke and heat, are known. However, to simultaneously sense all three conditions, it may be necessary to utilize three separate devices which increases the overall costs. Moreover, installation of these devices at a single site may be awkward, if not impossible. Accordingly, it is desirable to have a device which can incorporate at least three sensors and an alarm circuit, the alarm sounding a different audio pattern according to the condition being sensed. It is also desirable to enable the power source of the device to be charged by outside light, the housing of the system being able to receive solar or light energy from various directions.

In response thereto I have invented a tri-modal warning system having three units capable of detecting dangerous conditions such as smoke, heat and carbon monoxide. The housing enables the three sensing units to be simultaneously positioned at a single location. Solar cells are located about the housing which convert light into a trickle electrical charge delivered to the alarm circuit's battery. An integrated circuit logic chip receives the current, as regulated by the sensors, and presents an output current to the alarm in preselected patterns according to the input current received.

Accordingly, it is a general object of this invention to provide a warning system capable of sensing a plurality of dangerous conditions of the surrounding air.

It is another general object of this invention to provide a warning system, as aforesaid, wherein the pattern of the warning alarm will vary according to the sensed condition.

A further object of this invention is to provide a warning system, as aforesaid, within a housing which effectively positions a plurality of ambient air sensors at a common location.

Still a further object of this invention is to provide a warning system with housing, as aforesaid, the housing presenting solar cells for converting light into energy for the internal power source of the system.

A further object of this invention is to provide a warning system, as aforesaid, wherein the sensing units can be selected according to the desired conditions to be sensed.

A particular object of this invention is to provide a housing which effectively contains an electrical warning system activated by three sensors capable of detecting various conditions of the ambient air.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
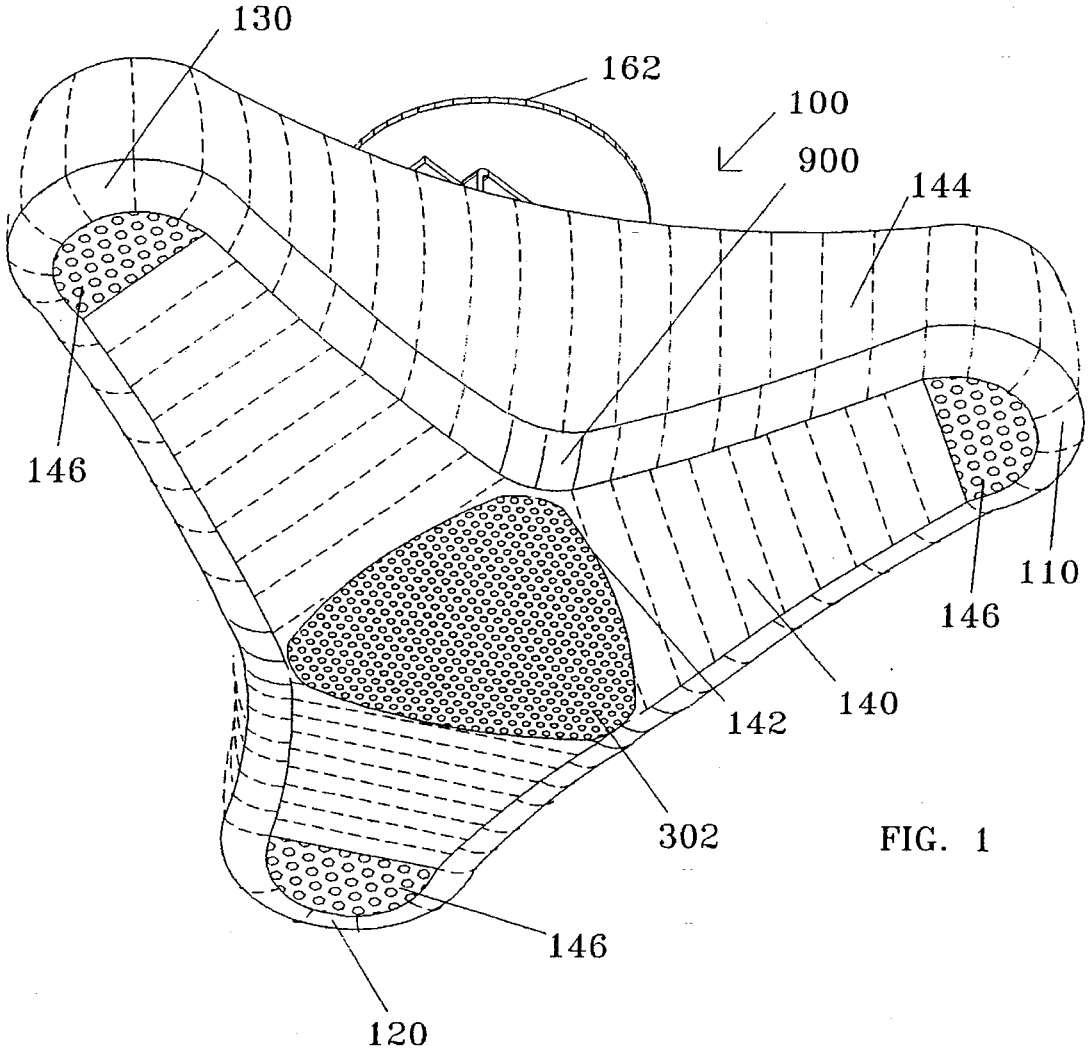
FIG. 1 is a perspective view of the housing for the alarm system generally from the underside thereof.
Figure 2:
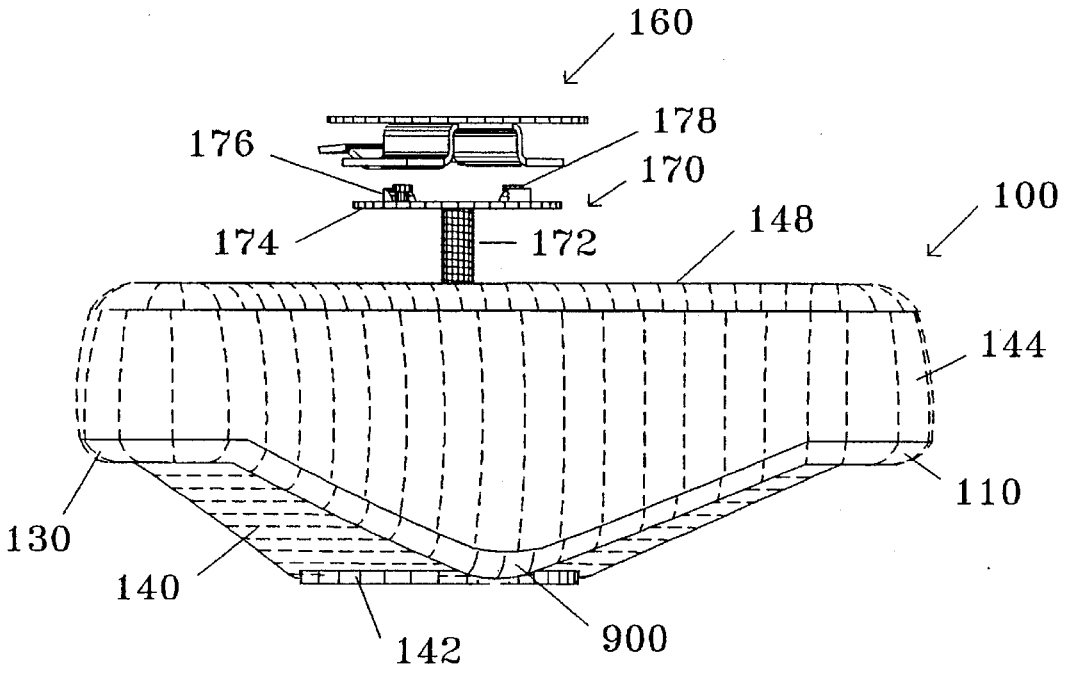
FIG. 2 is a side view of the housing of FIG. 1 and showing the mounting apparatus in an exploded condition.
Figure 3:
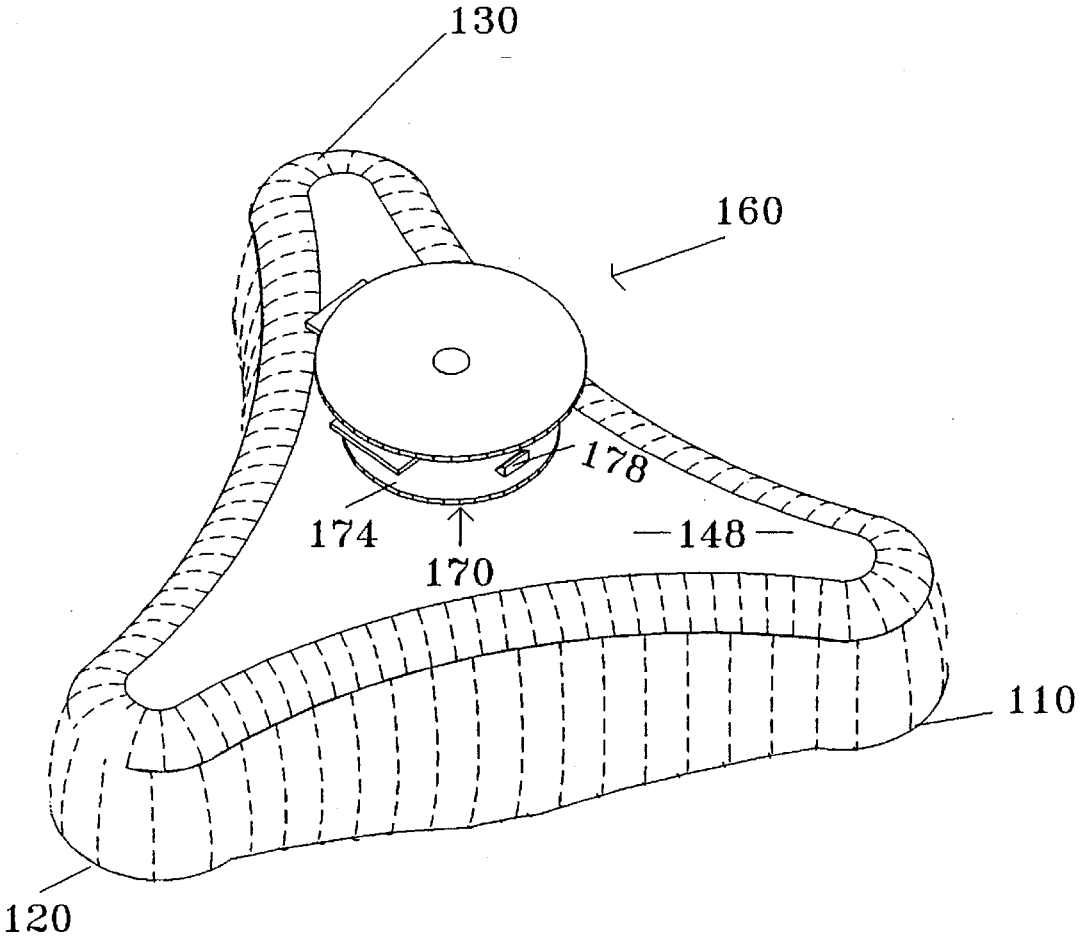
FIG. 3 is a top perspective view of the warning system of FIG. 1.
Figure 4:
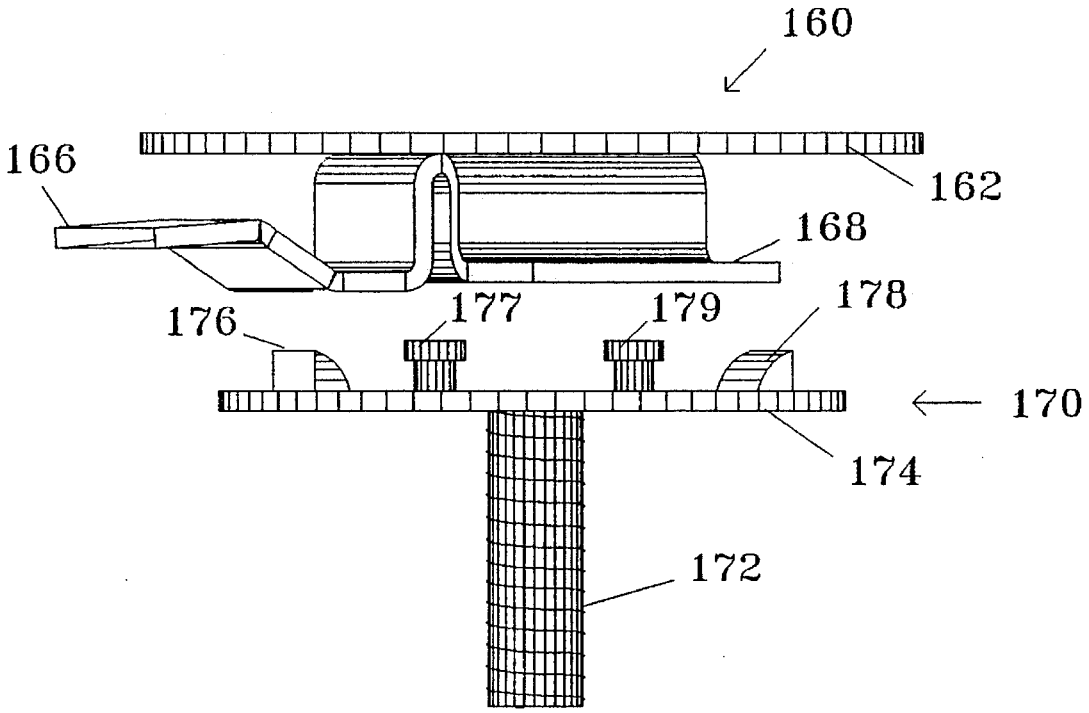
FIG. 4 is a side elevation view of the mounting brackets of the system on an enlarged and exploded scale.

Turning more particularly to the drawings, FIG. 1 illustrates a housing 100 as generally comprising a triangular configuration presenting lobes 110, 120, 130 at the corners thereof. The bottom surface 140 of the housing presents perforations 146 at these lobes 110, 120, 130 for passage of the air of the surrounding environment therethrough. This bottom surface 140 presents a depending central portion 142 of surface 140, this central portion 142 being disposed below the sidewall 144 of housing 100 (FIG. 2). Perforations 302 for passage of sound therethrough are in this central portion 142.

Interposed between the lobes 110, 120, 130 are solar cells 900 for converting light, as received from outside sources, to electrical energy. Such energy trickle charges the power source 910 of the associated alarm circuitry, one form being shown in FIG. 6. As such one or more of the cells 900 can receive outside light from various directions irrespective of the mounted position of the housing 100.

Figure 8:
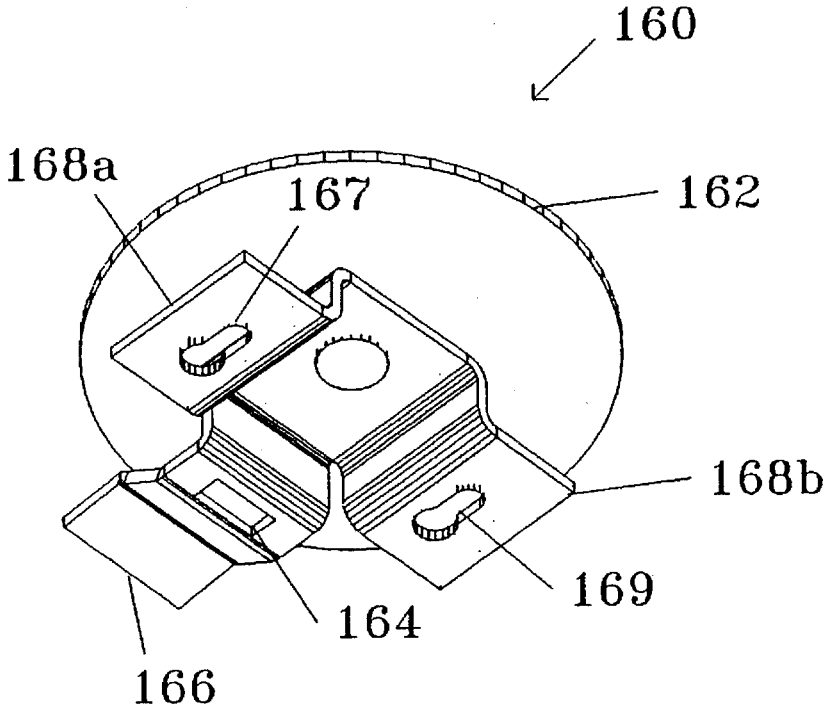
FIG. 8 is a view of the top plate of the housing mounting bracket.

The housing 100 is mounted to a ceiling or like by means of a bracket assembly 170 attached to the ceiling bracket 160. The housing bracket assembly 170 extends from the top surface 148 of housing 100, the length of extension of the bracket 170 from housing 100 surface 148 being adjustable by rotation of a screw 172. Extending from the top plate 174 of bracket 170 are a plurality of lugs 176, 178 and heads 177, 179. Either lug 176, 178 is designed to engage aperture 164 found within flange 166 extending from the plate 162 of bracket 160 (FIG. 8). The bolt heads 177, 179 engage apertures 167, 169 found in flanges **168*a*, 168*b* depending from plate 162 (FIG. 8). Other methods of mounting the housing 100** to the ceiling may be utilized.

Figure 5:
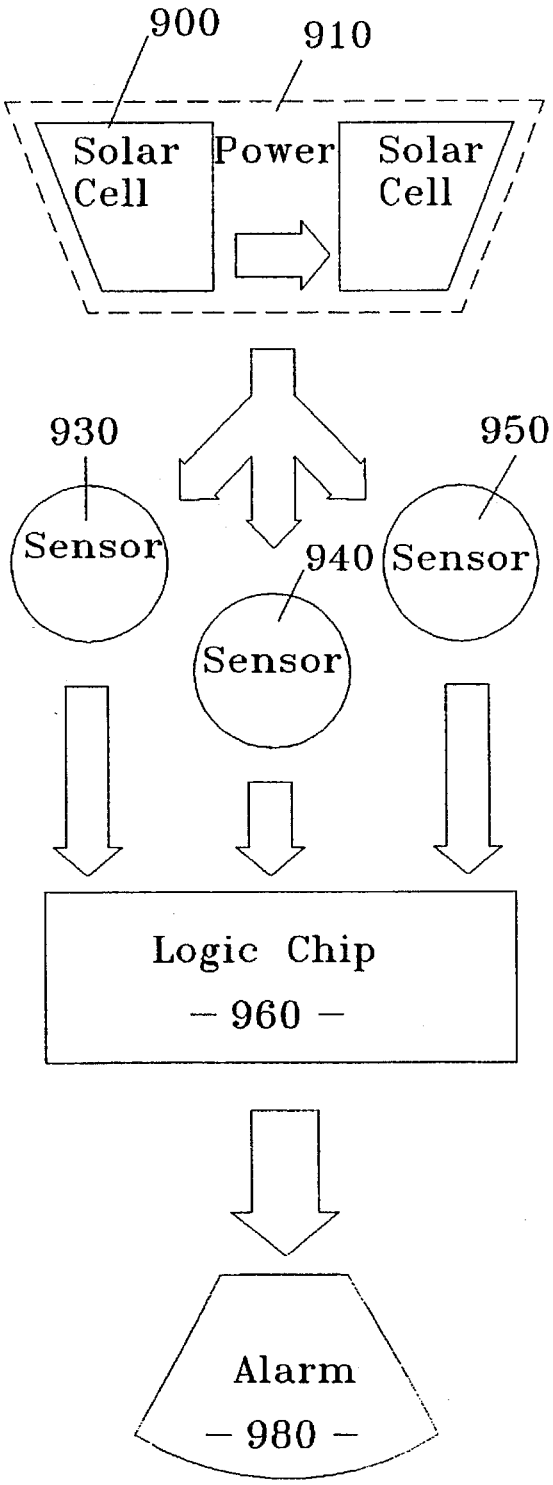
FIG. 5 is a block diagram showing the components of the warning system.
Figure 6:
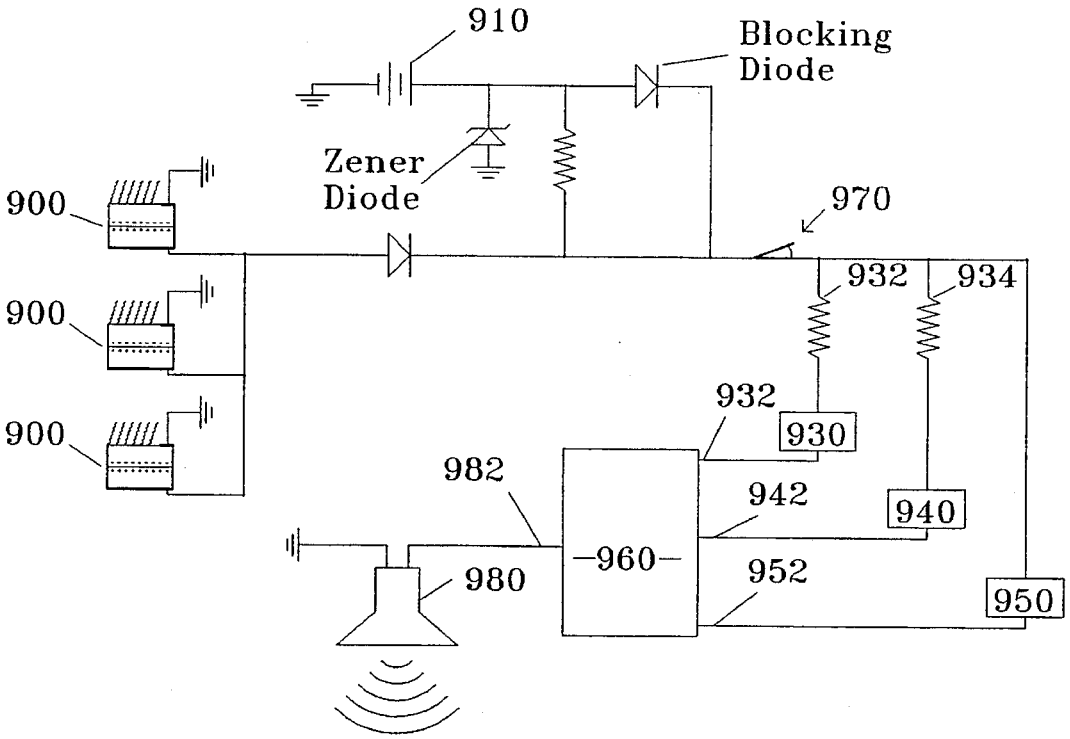
FIG. 6 is one electrical schematic diagram for the warning system.
Figure 7:
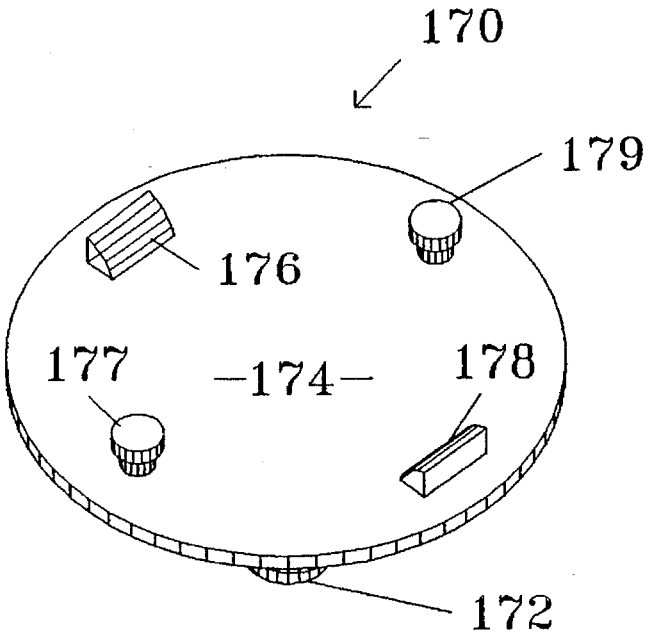
FIG. 7 is a view of the underside of the ceiling mounting bracket.

As shown in FIGS. 5 and 6, three sensor units 930, 940, 950 are utilized which can sense various conditions of the ambient air passing through the lobe 110, 120, 130 perforations 142 such as carbon monoxide, smoke and heat. These sensors 930, 940, 950 are part of the alarm circuitry (FIG. 6) and are placed in the various lobe portions 110, 120, 130 of the housing 100 adjacent perforations 142.

One form of alarm circuitry is shown in FIG. 6 wherein the sensors 930, 940, 950 receive current from power source 910. Sensors 930, 940, 950 at a predesigned ambient air condition will cause current to flow to an integrated circuit logic chip 960. The delivered current value is varied by resistors 932, 934. The integrated logic chip 960 will receive the input current and regulate the output current to alarm 980. The integrated chip may be made up of a combination of gates and/or flip-flops such that the output current from chip 960 at 982 will depend upon the input current at 932,942,952. Thus, the pattern of current flow to the alarm 980 can be varied so that the alarm 980 will sound in a pattern according to the type of ambient air condition being sensed. (In lieu of chip 960 various relays may be used which can vary the pattern of current flow to alarm 980.)

The power for the FIG. 6 circuitry is provided by a nickel cadmium battery 910, the current being delivered to the sensors 930, 940, 950 through the normally closed circuit deactivation switch 970. The solar cells 900 as shown will deliver a trickle charge through the diode 902 so as to assure that the power is available to keep sensors 930, 940, 950 in a ready state. It is understood that various forms of other circuitry may be utilized.

The use of the triangular housing enables the sensors 930, 940, 950 to be easily spaced about a central alarm, the sensors being part of an alarm circuit stored within housing 100. Moreover, the depending alarm at 142 assures that the sound waves of the alarm 980 will project beyond the housing.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An alarm for sensing a plurality of conditions of an ambient air comprising:

a housing, said housing having a generally triangular configuration and including:

first, second and third lobes at corners of said housing;

perforations in a lower surface of said housing and at said lobes for passage of the ambient air therethrough;

a perforated central portion in said lower surface of said housing for passage of sound therethrough;

an alarm circuit in said housing comprising:

a power source for said circuit;

an alarm adjacent said central portion of said housing;

an air sensor in each respective lobe, each sensor causing a particular current flow to sound said alarm upon sensing a predetermined condition of the ambient air, the alarm sound passing through said central portion.

2. The system as claimed in claim 1 wherein said alarm circuit further comprises logic means intermediate said sensors and said alarm, said logic means delivering a current to energize said alarm according to said particular current flow received from said sensors.

3. The system as claimed in claim 1 wherein one of said sensors monitors a carbon monoxide condition of the ambient air.

4. The system as claimed in claim 1 wherein one of said sensors monitors a temperature condition of the ambient air.

5. The system as claimed in claim 1 wherein one of said sensors monitors a smoke condition of the ambient air.

6. The system as claimed in claim 1 wherein said alarm circuit further comprises at least one solar cell interposed in said housing between said housing lobes for converting outside light energy into electrical energy for charging said power source.

7. The system as claimed in claim 1 wherein said central portion of said housing depends below said lobes, whereby said housing does not interfere with said alarm sound.

8. A device for containing an alarm circuit comprising:

a housing, said housing having a generally triangular configuration and including:

first, second and third lobes at corners of said housing for containing ambient air sensors of the alarm circuit;

apertures in a lower surface of said housing and at said lobes for passage of the ambient air therethrough and onto the sensors;

a perforated central portion in said lower surface of said housing for passage of sound therethrough from an alarm of the circuit; and means for mounting said housing to a selected surface.

9. The device as claimed in claim 8 wherein said central portion depends below said lobes.

10. The device as claimed in claim 8 wherein said housing further comprises a sidewall extending between said lobes, said sidewall presenting an aperture between said lobes for entry of light therethrough and onto a solar cell of the circuit.

11. An alarm for sensing a plurality of conditions of an ambient air comprising:

a housing, said housing having a configuration presenting a plurality of spaced apart lobes;

perforations in said lobes for passage of the ambient air therethrough;

a perforated central portion in said lower surface of said housing encompassed by said lobes for passage of sound therethrough;

an alarm circuit in said housing comprising:

a power source for said circuit;

an alarm adjacent said central portion of said housing;

an ambient air sensor respectively positioned in each lobe, each of said sensors causing a particular current flow to sound upon sensing a predetermined condition of the ambient air, the alarm sound passing through said central portion.

12. The system as claimed in claim 11 wherein said alarm circuit further comprises logic means intermediate said sensors and said alarm, said logic means delivering a current to energize said alarm according to said particular current flow caused by said sensors.

13. The system as claimed in claim 11 wherein one of said sensors monitors a carbon monoxide condition of the ambient air.

14. The system as claimed in claim 11 wherein one of said sensors monitors a temperature condition of the ambient air.

15. The system as claimed in claim 11 wherein one of said sensors monitors a smoke condition of the ambient air.

16. The system as claimed in claim 11 wherein said circuit further comprises at least one solar cell interposed in said housing between said housing lobes for converting outside light energy into electrical energy for charging said power source.

17. The system as claimed in claim 11 wherein said central portion of said housing depends below said lobes, whereby said housing does not interfere with said alarm sound.

* * * * *

UNITED STATES PATENT AND TRADEMARK OFFICE

CERTIFICATE OF CORRECTION

PATENT NO. : 5,589,824

DATED : December 31, 1996

INVENTOR(S) : Adam Q. Lynch

It is certified that error appears in the above-identified patent and that said Letters Patent is hereby corrected as shown below:

Column 4, line 29, delete the first occurrence of "said" and substitute --a-- therefor.

Signed and Sealed this

Seventeenth Day of February, 1998

Bruce Lehman

*Attest:*

BRUCE LEHMAN

*Attesting Officer*

*Commissioner of Patents and Trademarks*